United States Patent [19]

Ward, Jr.

[11] Patent Number: 4,815,746

[45] Date of Patent: Mar. 28, 1989

[54] BENCH PRESS FRAME WITH BARBELL ASSIST

[76] Inventor: Walter F. Ward, Jr., 202 E. California St., Vivian, La. 71064

[21] Appl. No.: 122,054

[22] Filed: Nov. 17, 1987

[51] Int. Cl.[4] ..... A63B 13/00

[52] U.S. Cl. ..... 272/123; 272/117; 272/134

[58] Field of Search ..... 272/96, 117, 118, 123, 272/134, 143, 144, DIG. 4

[56] References Cited

U.S. PATENT DOCUMENTS

| | | | |
|---|---|---|---|
| 4,256,301 | 3/1981 | Goyette | 272/123 |
| 4,407,495 | 10/1983 | Wilson | 272/117 |
| 4,456,246 | 6/1984 | Szabo | 272/118 |
| 4,471,956 | 9/1984 | Marlo | 272/123 |
| 4,502,681 | 5/1985 | Blomquist | 272/117 X |
| 4,637,608 | 1/1987 | Owens et al. | 272/123 X |
| 4,700,944 | 10/1987 | Sterra et al. | 272/117 |

FOREIGN PATENT DOCUMENTS

| | | | |
|---|---|---|---|
| 3443267 | 3/1986 | Fed. Rep. of Germany | 272/134 |
| 3528994 | 2/1987 | Fed. Rep. of Germany | 272/123 |
| 8607274 | 12/1986 | PCT Int'l Appl. | 272/134 |
| 2149676 | 6/1985 | United Kingdom | 272/123 |

*Primary Examiner*—Richard J. Apley
*Assistant Examiner*—Robert W. Bahr
*Attorney, Agent, or Firm*—John M. Harrison

[57] ABSTRACT

A bench press frame with barbell assist which is characterized by a bench press frame having a foot assist assembly and a system of pulleys attached to the frame. A pair of cables traverses the pulleys and one end of the cables is attached to a barbell seated on the bench press frame, while the opposite end of the cables is secured to a pivoting element in the foot assist assembly. The pivoting element is pivotally mounted to the bench of the bench press frame and is adapted for optional manipulation by the feet to assist the arms in raising the barbell to a pair of barbell flanges attached to the bench press frame when the barbell is lifted in conventional fashion during bench press exercises. The foot assist assembly is designed to assist a weight lifter during the bench press exercises when the exercise is fatigued and unable to replace the barbell on the barbell flanges during a final bench press repetition.

5 Claims, 1 Drawing Sheet

BENCH PRESS FRAME WITH BARBELL ASSIST

BACKGROUND OF THE INVENTION

1. Field of the Invention

This invention relates to weight lifting equipment and more particularly, to a bench press frame with barbell assist which is characterized by a bench press frame fitted with multiple, spaced pulleys for receiving a pair of cables, spaced common ends of which cables are attached to a barbell resting on the bench press frame and the opposite ends of which are secured to the pivoting element of a foot assist assembly. The pivoting element is pivotally attached to the lower end of the bench in the bench press frame and is positioned to receive the feet of an exerciser when the exerciser is lying on the bench facing upwardly and is grasping the barbell in bench-press orientation. Accordingly, when the barbell is grasped by the exerciser in this manner and is raised and lowered in conventional bench-press sequence, the pivoting element in the foot assist assembly can be selectively manipulated by the instep of the feet to assist the arms in raising the barbell during the last of a series of repetitions and help replace the barbell on a pair of barbell flanges extending from the bench press frame. In a preferred embodiment of the invention, a pair of adjusting chains connect corresponding ends of the cables to the pivoting element of the foot assist assembly by means of S-hooks, in order to adjustably link the cables to the pivoting element, adjust the travel of the cables and compensate for the difference in arm and leg length of various people who use the bench press frame with barbell assist.

2. Description of the Prior Art

In recent years, there has developed an explosion in the design and use of exercising equipment, with modern emphasis away from the older "free weight" exercise apparatus, in favor of sophisticated apparatus and equipment which utilize air cylinders, pulleys and rod-mounted stacked weight systems, as well as other resistant-type apparatus for application of tension and compression on the body. U.S. Pat. No. 4,358,108, dated Nov. 9, 1982, to Harvey C. Voris, discloses an "Apparatus For Exercising the Hamstring or Quadricep Muscle Groups". This patent details a combined exercise apparatus which includes a frame, a structure for locating at least one knee of a user relative to the frame when the user is either in a sitting or a standing position and a mechanism for engaging and resisting pivotal movement of the lower leg of the user. Engaging and resisting means includes at least one pivot arm engagable with the lower leg of the user and suspended for pivotal movement about a machine axis parallel to the joint axis of the knee, the location of the machine axis being adjustable to substantially coincide with the joint axis of the user's knee when the user is in either the sitting or the standing position. U.S. Pat. No. 4,390,179, dated June 28, 1983, to K. Z. Szkalak, discloses a "Multi-Station Exercising Apparatus". This device includes a structural framework having a number of positions for stationing different types of exercising machines. Each of the machines is of the type which employs a pulley system to lift a variable weight. All of the pulley systems share a common central pulley which is pivotally attached to the frame-work. A single rope or cable is attached to the variable weight, passes through the central pulley and is removably attachable to the appropriate component of each of the exercising machines.

The pivoting central pulley thus allows the weight to be selectively attached to the desired machine by means of the cable. Another "Exercise System" is detailed in U.S. Pat. No. 4,505,475, dated Mar. 19, 1985, to Brad Olschansky, et al. The system facilitates reversible displacement of at least one weight element responsive to a lifting force imparted to the weight element by a user. The apparatus includes an exercise frame, as well as an arm-actuated mechanism and a leg-actuated mechanism. The arm-actuated mechanism is secured to the exercise frame and is coupled to the weight element for reversibly displacing the weight element. The leg-actuated mechanism is also secured to the exercise frame and is further coupled to the weight element to allow reversible displacement of the weight element responsive to movement of the legs of the user. An exercise coupling mechanism is secured to the exercise frame and the weight element, in order to couple the arm-actuated mechanism to the leg-actuated mechanism for providing a lifting force to the weight element responsive to independent actuation of the leg mechanism or the arm mechanism or, in the alternative, to allow for a combined actuation of the leg and/or arm mechanisms. U.S. Pat. No. 4,650,186, dated Mar. 17, 1987, discloses a "Supine Bench With Leg Operated Free Weight Catch" developed by M. J. McCreery. In this weight system an elongated bench support, including head and foot ends, is provided for disposition in a generally horizontal or inclined position and against which a person wishing to carry out bench press exercises may repose on his or her back. Upstanding guide structure is disposed adjacent the head end of the bench support and follower structure is mounted thereon for guided movement herealong. The follower structure includes a bar-supporting structure for supporting a weighted bar therefrom and a foot-engagable support is mounted from the foot end of the bench support for guided movement generally longitudinally of the bench support. Motion transmitting structure operatively connects the foot-engagable support and the follower structure for raising and lowering the latter responsive to movement of the foot-engagable support away from and toward the head end of the bench. Further, releasable ratchet-type latch structure is operatively associated with the follower structure for releasably latching the follower structure against downward movement relative to the guide structure. The foot-engagable support includes latch operator structure shiftably supported therefrom for selectively actuating and releasing the latch structure. An "Exercise Apparatus" is detailed in U.S. Pat. No. 4,678,185, dated July 7, 1987, to Parker E. Mahnke. The patent details a bench-type exercise device which can be readily adjusted into several different starting positions to permit the performance of a wide variety of body exercises in sitting, prone and reclined positions. The device is provided at the outboard end with a body-engaging subassembly which, in a lowered position, can be used for various leg exercises, such as leg extensions and in a raised position, can be used for the performance of various arm exercises such as arm curls. The device further embodies a remotely-located weight stack or other resistance-providing mechanism which is uniquely interconnected with the body-engaging subassembly by means of an adjustable linkage assembly to provide a constant, common, uniform and predetermined resistance to pivotal movement of the body-engaging elements, whether the elements are disposed in a lowered or elevated position and whether the device is being used for the performance of leg or arm exercises.

It is an object of this invention to provide a bench press frame having a barbell assist which is designed to assist the arms in lifting a barbell during bench press exercises, by using the feet and legs.

Another object of this invention is to provide a new and improved assist mechanism for a bench press apparatus, which assist mechanism is characterized by a bench frame-mounted pulley and cable system that is operative to assist the arms in raising a barbell to a predetermined point of rest on the bench press apparatus, by using the feet and legs, in order to safeguard the exerciser during bench press exercising.

Still another object of this invention is to provide a bench press frame with barbell assist which is characterized by multiple pulleys mounted on a bench press frame supporting a barbell, which pulleys are traversed by a pair of spaced cables, respectively, a common end of each of which cables is attached to the barbell near the ends of the barbell and the opposite ends of the cables attached to the pivoting element of a pivoting foot assist assembly, wherein additional lift can be imparted to the barbell by operation of the foot assist assembly during bench press exercises to aid the exerciser in extending his arms and replacing the barbell on the bench press frame.

Still another object of the invention is to provide a bench press frame having a barbell assist therein, which barbell assist further includes a system of spaced pulleys attached to the bench press frame and carrying a pair of cables, a common end of which cables is attached in spaced relationship to a barbell resting on the bench press frame and the opposite ends to a chain connected to the pivoting element of a pivoting foot assist assembly, which is designed to assist the arms in raising the barbell to a predetermined height by operation of the feet during bench press workouts.

SUMMARY OF THE INVENTION

These and other objects of the invention are provided in a new and improved bench press frame with barbell assist, which barbell assist includes a pair of cables traversing a parallel system of pulleys mounted in spaced relationship on the bench press frame, one end of each of which cables is attached to a bench press frame-supported barbell near the ends of the barbell, respectively, and the opposite common ends of the cables secured to a chain attached to the pivoting element of a pivoting foot-operated assist assembly. Optional assistance in raising the barbell by the arms to a predetermined height by an exerciser during bench press workouts is effected by operation of the feet and legs in manipulating the pivoting element in the foot-operated assist assembly to tension the cables.

BRIEF DESCRIPTION OF THE DRAWING

The invention will be better understood by reference to the accompanying drawing, wherein.

DESCRIPTION OF THE PREFERRED EMBODIMENTS

Figures 1, 2, 3, 4:
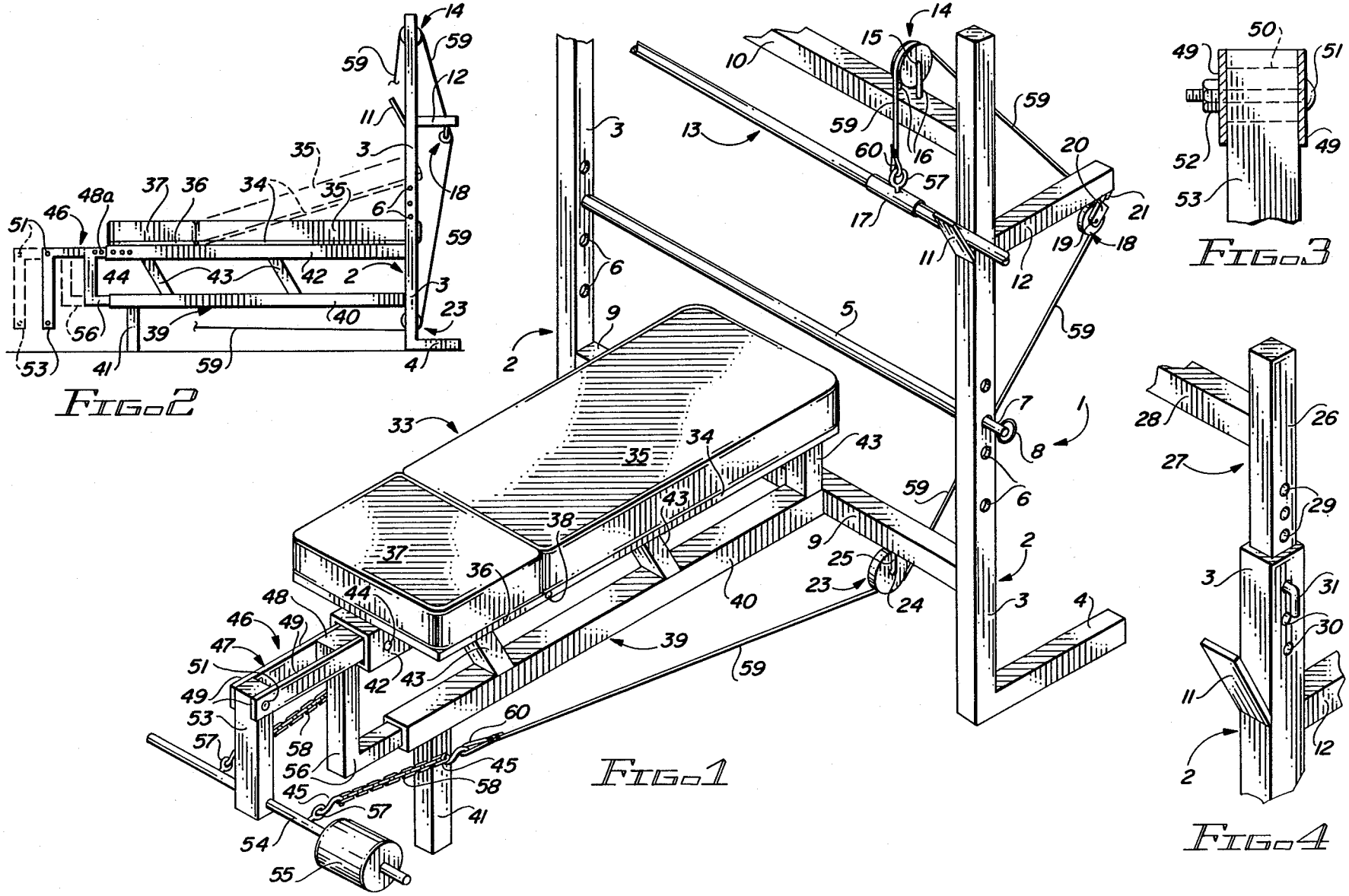
FIG. 1 is a perspective view, partially in section, of a preferred embodiment of the bench press frame with barbell assist of this invention.
FIG. 2 is a side view of the bench press frame with barbell assist illustrated in FIG. 1, more particularly illustrating a preferred adjustment feature for the foot assist assembly.
FIG. 3 is a sectional view of a preferred pivoting element of the foot assist assembly provided in the bench press frame with barbell assist illustrated in FIG. 1.
FIG. 4 is a perspective view, partially in section, of an alternative frame leg extension provided in association with the bench press frame with barbell assist illustrated in FIG. 1.

Referring initially to FIG. 1 of the drawing, the bench press frame with barbell assist is generally illustrated by reference numeral 1. The bench press frame with barbell assist 1 is characterized by a pair of vertical frame legs 2, each of which is further characterized by a vertical member 3 and a foot 4, (only one of which is illustrated in FIG. 1) extending in horizontal relationship from the bottom end of the vertical member 3, for supporting the frame legs 2, respectively. An adjustable support 5 is extended between the vertical members 3 of the frame legs 2 and is adjustably attached to the vertical members 3 by a pair of bench support pins 7, (one of which is illustrated in FIG. 1) each of which support pins 7 is fitted with a pin ring 8 and extends through a selected set of bench support adjusting holes 6, provided in each of the vertical members 3, respectively, into the ends of the adjustable support 5. A bottom cross brace 9 spans the vertical members 3 of the frame legs 2 in fixed relationship below the adjustable support 5, as does a top cross brace 10, located above the adjustable support 5, as illustrated. A pair of barbell flanges 11 (one of which is illustrated in FIG. 1) extend outwardly from fixed, angular attachment to the vertical members 3, in order to receive the ends of a barbell 13 and support the barbell 13 on the vertical members 3 of the frame legs 2. A pair of middle pulley bars 12 (one of which is illustrated in FIG. 1) project rearwardly from the vertical members 3 of the frame legs 2 opposite the barbell flanges 11, respectively, parallel to each foot 4. Each of the middle pulley bars 12 receive and mount a middle pulley 18 (one of which is illustrated in FIG. 1) by means of a pair of middle pulley legs 20 and a companion middle pulley pin 19, as further illustrated in FIG. 1. Accordingly, each middle pulley pin 19 rotatably mounts the companion middle pulley 18 on the corresponding set of middle pulley legs 20, which are connected to a pulley spring 21, secured to the middle pulley bar 12, for maintaining tension on the cables 59, respectively. Similarly, a pair of top pulleys 14 (one of which is illustrated in FIG. 1) are mounted in spaced relationship on the top cross brace 10 of the frame legs 2 in a common plane with the companion middle pulley 18, respectively, by means of a cooperating pair of spaced top pulley legs 16 and cooperating top pulley pins 15, respectively. In like manner, a pair of bottom pulleys 23 (one of which is illustrated in FIG. 1) are mounted in spaced relationship on the bottom of the bottom cross brace 9 by means of parallel bottom pulley legs 25 and a cooperating bottom pulley pin 24, respectively. The bottom pulleys 23 are aligned in a common plane with the companion middle pulleys 18 and top pulleys 14, respectively. A pair of cable sleeves 17 (one of which is illustrated in FIG. 1) are provided on the barbell 13 in spaced relationship, with an eye bolt 57 secured to each of the cable sleeves 17, respectively. A pair of cables 59 (one of which is illustrated in FIG. 1) are extended around the aligned sets of top pulleys 14, middle pulleys 18 and bottom pulleys 23, respectively. The ends of the cables 59 are each provided with a cable eye 60 for attachment to the eye bolts 57, carried by the respective cable sleeves 17, and to one end of a pair of chains 58, the opposite ends of which chains 58 are secured to another set of eye bolts 57, attached to the kick bar 54 element of a foot assist assembly 46, respectively. In a preferred embodiment of the invention, a first pair of S-hooks 45 are designed to extend through selected links in the chains 58, respectively, in order to adjustably secure one end of the chains 58 to the companion eye bolts 57, secured to the kick bar 54. A second pair of S-hooks 45 may be used to attach the cable eyes 60 of the cables 59 to the opposite ends of the chains 58, respectively.

As further illustrated in FIGS. 1 and 3, a bench 33 extends from the frame legs 2 and in a preferred embodiment, the bench 33 is characterized by a bench frame 39, having a frame brace 40, which is welded or otherwise fixedly attached at one end to the bottom cross-brace 9 of the frame legs 2 and is supported by a frame brace leg 41 at the opposite end. A back support plate 34 supports a back pad 35 and rests on a supporting plate frame 42, which is secured in horizontal, vertically parallel alignment with the underlying frame brace 40 by means of three spaced frame connectors 43. Furthermore, a seat plate 36, provided with a seat pad 37, is attached to the back support plate 34 by means of a plate hinge 38. The seat plate 36 is welded or otherwise secured to the plate frame 42. The foot assist assembly 46 is further characterized by a bifurcated bar 47, provided with a bar base 48 at one end, which bar base 48 telescopes in adjustable relationship inside the plate frame 42. A downwardly-extending, L-shaped bar brace 56, having one end welded or otherwise fixedly attached to the bar base 48 and the opposite end extending in telescoping fashion inside the frame brace 40, serves to brace the bifurcated bar 47. One end of a kick mount bar 53 is pivotally attached to the extending ends of the bar plates 49 by means of a bar plate bolt 51 and a cooperating nut 52, as illustrated in FIG. 3. The kick bar 54 extends transversely through the opposite, unpivoted end of the kick mount bar 53 and is provided with a pair of kick bar pads 55 (one of which is illustrated in FIG. 1 for clarity), designed for engagement with the instep of the foot or feet of an exerciser, in order to use the bench press frame with barbell assist of this invention, as hereinafter further described.

Referring now to FIGS. 1 and 2 of the drawing, in a most preferred embodiment of the invention the foot assist assembly 46 is horizontally adjustable with respect to the plate frame 42 and the frame brace 40 in the bench 33, by inserting a pin (not illustrated}through a selected one of the plate frame adjusting holes 44, provided in the plate frame 42 and a registering one of the bar base adjusting apertures 48*a*, located in the bar base 48, to position the kick mount bar 53 and kick bar 54 outwardly of the bench 33 in a comfortable position for use by an exerciser when lying on his back on the back pad 35 and seat pad 37, in bench press posture. This adjustment also serves to adjust the travel of the cables 59 and the barbell 13 and facilitates accommodation of weight lifters of varying height and arm length. Furthermore, as further illustrated in FIG. 2, the free, unhinged end of the back support plate 34 and the back pad 35 can be raised from a resting position on the plate frame 42 by operation of the plate hinge 38 and the raised end seated on the adjustable support 5 at a selected level, to adjust the position of an exerciser into an alternative bench press configuration, as desired.

Referring again to FIGS. 1 and 3 of the drawing, in a most preferred embodiment of the invention a bushing 50 is provided in that end of the kick mount bar 53 which is mounted to the bar plates 49 of the bifurcated bar 47, in order to facilitate a more smooth pivotal motion between the kick mount bar 53 and the bifurcated bar 47, when the foot assist assembly 46 is used.

As further illustrated in FIGS. 1 and 4 of the drawing, in still another preferred embodiment of the invention the vertical legs 26 (one of which is illustrated in FIG. 4) of a frame leg extension 27 are telescopically inserted in the top end of the vertical members 3 of the frame legs 2, respectively. The frame leg extension 27 in this embodiment of the invention carries the extension cross brace 28 and the vertical legs 26 are further provided with extension adjusting holes 29 that register with cooperating vertical member adjusting holes 30, provided in the companion vertical members 3, in order to receive a pair of L-pins 31, for adjusting the height of the frame leg extension 27 with respect to the frame legs 2, respectively.

In operation, referring again to the drawing, an exerciser initially mounts the bench 33, resting his back and buttocks on the back pad 35 and seat pad 37, respectively. He then grasps the barbell 13 with both hands spread and positioned adjacent the cable sleeves 17, while the barbell 13 is resting on the parallel barbell flanges 11, as illustrated. The barbell 13 is then lifted free of its resting position on the barbell flanges 11, which action facilitates bench-pressing the barbell 13 in a desired number of repetitions while the cables 59 are attached to the respective cable sleeves 17. This repetitive up-and-down motion causes the spring 21 to expand and compress to maintain tension in the cables 59. If during the last repetition, due to fatigue, the weight lifter is unable to raise the barbell to the barbell flanges 11 and lock his elbows, he can engage the kick bar pads 55 with his insteps, pivot the kick bar 54 forwardly and upwardly with his legs and thereby apply tension to the cables 59. This action exerts an upward force on the barbell 13 and assists the arms in replacing the barbell 13 on the barbell flanges 11.

It will be appreciated by those skilled in the art that the foot assist assembly 46, top pulleys 14, middle pulleys 18 and bottom pulleys 23 illustrated in FIG. 1 can be mounted on substantially any desired bench press frame to create a bench press frame with barbell assist of selected design. Furthermore, the size and spacing of the top pulleys 14, middle pulleys 18 and bottom pulleys 23 can be varied, in order to properly accommodate the cables 59 for smooth operation of the foot assist assembly 46. While the cables 59 can be of substantially any design, a steel cable core encapsulated by a plastic sleeve is preferred for smooth operation of the top pulleys 14, middle pulleys 18 and bottom pulleys 23. The top pulleys 14, middle pulleys 18 and bottom pulleys 23 are also preferably constructed of a nylon or plastic material for greater compatibility with the plastic-coated cables 59.

Referring again to FIGS. 1 and 2 of the drawing, it will be further appreciated that the back support plate 34 and back pad 35 can be declined, as well as inclined on the plate hinge 38, by modifying the front two frame connectors 43, according to the knowledge of those skilled in the art. Accordingly, it is understood that the bench press frame with barbell assist 1 can be operated with the back and shoulders of a weight lifter oriented in inclined, horizontal or declined configuration, as desired.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. In a bench press frame adapted to receive and support a barbell resting thereon the improvement, in combination therewith, comprising: a bench having one end secured to said bench press frame and the opposite end of said bench extending outwardly of said frame, said bench adapted to receive and support a user in repose, wherein the user is positioned to grasp the barbell in bench press configuration; foot-engaging means pivotally carried by said opposite end of said bench; a first set of pulleys including a first top pulley, a first middle pulley and a first bottom pulley mounted on said frame in spaced, rotatable relationship, a first spring operatively connected to said first middle pulley and said frame, and a first cable traversing said first set of pulleys, with one end of said first cable connected to the barbell and the opposite end of said first cable attached to said foot-engaging means; a second set of pulleys including a second top pulley, a second middle pulley and a second bottom pulley mounted on said frame in spaced, rotatable relationship with respect to said first set of pulleys, a second spring operatively connected to said second middle pulley and said frame; and a second cable traversing said second set of pulleys, with one end of said second cable connected to the barbell and the opposite end of said second cable attached to said foot-engaging means, whereby the barbell may be selectively raised by the user during bench press exercises responsive to manipulation of said foot-engaging means by the legs and feet of the user and said first spring and said second spring serve to maintain tension in said first cable and said second cable, respectively.

2. The bench press frame with barbell assist of claim 1 wherein said foot-engaging means further comprises a bifurcated bar carried by said bench in telescoping, adjustable relationship; a kick mount bar having one end pivotally carried by said bifurcated bar and a kick bar secured to said kick mount bar in transverse relationship, with said opposite end of said first cable and said opposite end of said second cable attached to said kick bar in spaced relationship, respectfully, whereby outward thrusting of said kick bar by the user's feet and legs assists the user in raising the barbell.

3. The bench press frame with barbell assist of claim 2 further comprising:

(a) a first length of chain extending between said opposite end of said first cable and said kick bar; first attachment means connecting said opposite end of said first cable to one end of said first length of chain; second attachment means connecting said opposite end of said first length of chain to said kick bar; a second length of chain extending between said opposite end of said second cable and said kick bar; third attachment means connecting said opposite end of said second cable to one end of said second length of chain; and fourth attachment means connecting said opposite end of said second length of chain to said kick bar, for adjusting the length of travel of said first cable and said second cable and the barbell; and (b) a back support plate provided on said bench and a back pad attached to said back support plate; a hinge carried by said bench, with one end of said back support plate attached to said hinge; and an adjustable support carried by said frame in adjustable relationship for receiving the opposite end of said back support plate and adjusting the angle of repose of said back support plate.

4. The bench press frame with barbell assist of claim 3 further comprising a frame leg extension carried by said frame in telescoping, adjustable relationship and wherein said first top pulley and said second top pulley are mounted on said frame leg extension, whereby the height of the barbell and said first top pulley and said second top pulley are located a selected distance from said bench responsive to vertical adjustment of said frame leg extension with respect to said frame.

5. The bench press frame with barbell assist of claim 4 wherein said first attachment means, said second attachment means, said third attachment means and said fourth attachment means each further comprises a S-hook.

* * * * *